United States Patent [19]

Marie et al.

[11] Patent Number: 4,848,753

[45] Date of Patent: Jul. 18, 1989

[54] APPARATUS FOR THE INNER AND OUTER QUENCHING OF TUBULAR PIECES

[75] Inventors: Daniel Marie, Rambouillet; Michel Rostan, St. Cyr L'Ecole; Marc Luco, Vert St. Denis; Henry Thoor, Corbeil Essonnes, all of France

[73] Assignee: Stein Heurtey, Ris Orangis, France

[21] Appl. No.: 141,497

[22] Filed: Jan. 7, 1988

[30] Foreign Application Priority Data

Jan. 8, 1987 [FR] France ..... 87.00104

[51] Int. Cl.[4] ..... C21D 9/08

[52] U.S. Cl. ..... 266/117; 266/159

[58] Field of Search ..... 266/114, 117, 259

[56] References Cited

U.S. PATENT DOCUMENTS 4,417,928 11/1983 Heine, Jr. et al. ..... 148/144

4,458,885 7/1984 Akita et al. ..... 266/117

4,461,462 7/1984 Mizushima et al. ..... 266/117

*Primary Examiner*—Christopher W. Brody

*Attorney, Agent, or Firm*—Sandler & Greenblum

[57] ABSTRACT

An apparatus for providing the outer quenching and the inner quenching of tubular pieces, notably of steel tubes, characterized in that it includes successively, in the advancement direction of the tubes:

slanting rollers allowing the tubes delivered continuously to move forward successively by rotating about their axis;

an outer quenching system;

a clamping and locking system for the tube;

a retractable carrier supporting an injection lance for carrying out the inner quenching, said carrier being provided with said clamping and locking system for the tube;

means allowing the carrier to move backward with the tube clamping system in order to accompany said tube in movement while the outer quenching is carried out; and retractable rollers which come in position to support the tube as the carrier moves backward while disengaging the tube from the outer quenching system.

20 Claims, 2 Drawing Sheets

APPARATUS FOR THE INNER AND OUTER QUENCHING OF TUBULAR PIECES

FIELD OF THE INVENTION

The present invention relates to an apparatus for the inner and outer quenching of tubular metallic pieces, and more particularly steel tubes. It is known that in the manufacture of steel tubes, quenching is one of the particularly important qualitative elements and that is gives rise to a number of technical problems difficult to solve, amongst which can be cited for example:

- the obtaining of a good homogeneity between the inner quenching and the outer quenching;
- the obtaining of a minimum deformation during quenching;
- the realization of an excellent surface state.

Generally, the quenching systems for metallic tubular products presently used do not allow solving entirely satisfactorily all said technical problems and this is the reason why the object of the invention is a quenching apparatus providing a quenching quality superior to that obtained with the various existing systems.

OBJECTS AND SUMMARY OF THE INVENTION

Consequently, this invention relates to an inner and outer quenching apparatus for tubular pieces, notably steel tubes, characterized in that it includes successively, in the advancement direction of the tubes:

- slanting rollers allowing the tubes delivered continuously to move forward successively by rotating about their axis;
- an outer quenching system;
- a clamping and locking system for the tube;
- a retractable carrier supporting an injection lance for carrying out the inner quenching, said carrier being provided with said clamping and locking system for the tube;
- means allowing the carrier tomove backward with the tube clamping system in order to accompany said tube in movement while the outer quenching is carried out; and
- retractable rollers which come in position to support the tube as the carrier moves backward while disengaging the tube from the outer quenching system.

According to a feature of this invention, the clamping and locking system for the tube is rigid with said carrier and includes: a hollow end-piece into which opens the inner quenching injection lance, said hollow end-piece including a frustoconical bearing surfavce on its faces placed opposite the outer quenching system in order to lock the tube front end, and pliers tiltably mounted on said end-piece and clamping the tube when said tube comes in abutment against the end-piece.

According to another feature of this invention, the carrier is mounted on a frame via arms, driven by cylinders, said frame moving on a rolling path, for example with the assistance of a pinion-rack system.

BRIEF DESCTIPTION OF DRAWINGS

Other features and advantages of this invention will become more apparent from the description below, with reference to the accompanying drawings illustrating an embodiment thereof having no limiting character, drawings wherein:

FIG. 1 is a side elevation view of the apparatus which is the object of the invention, and FIG. 2 is an end view of FIG. 1.

DETAILED DESCRIPTION OF THE INVENTION

Figure 1:
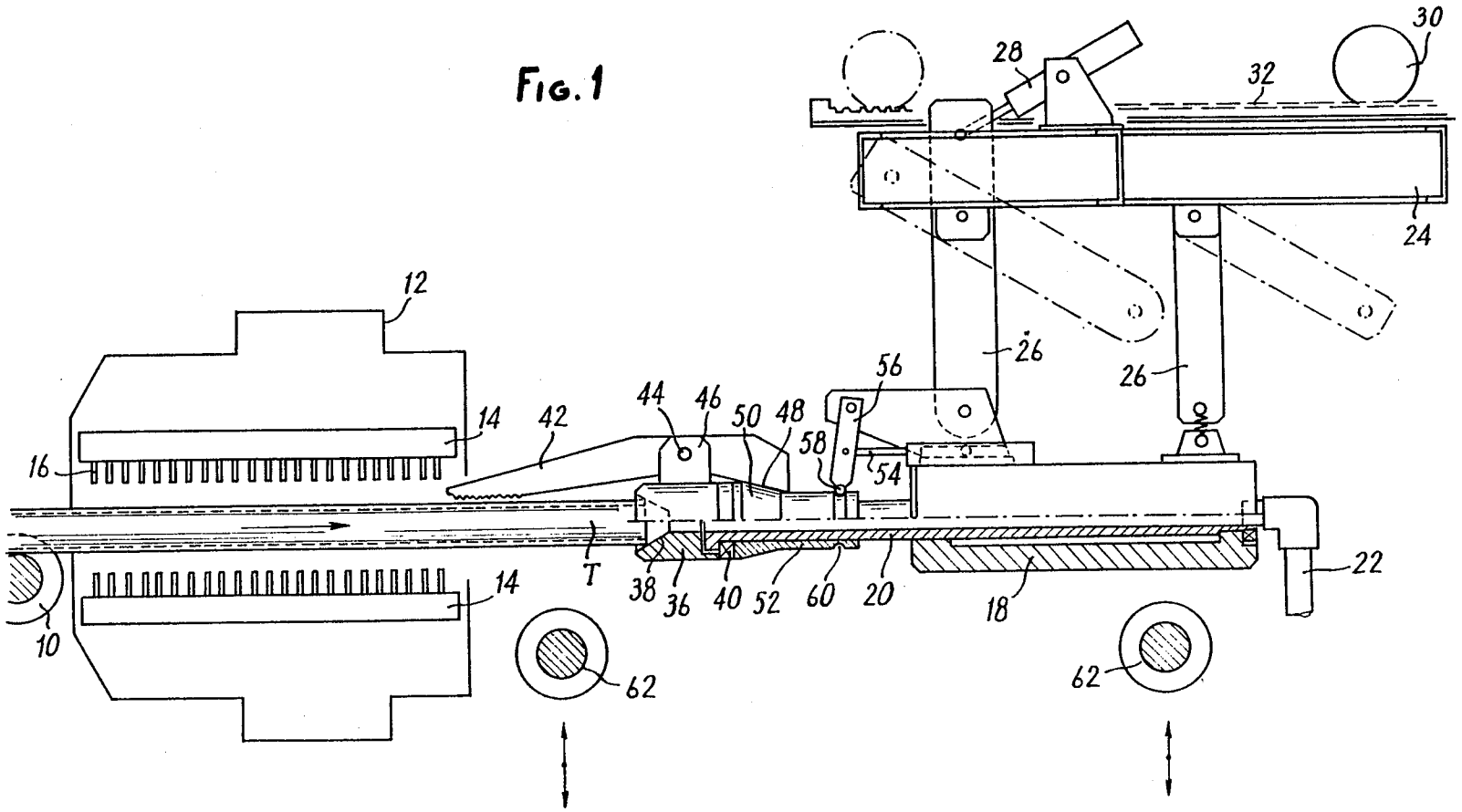
Figure 2:
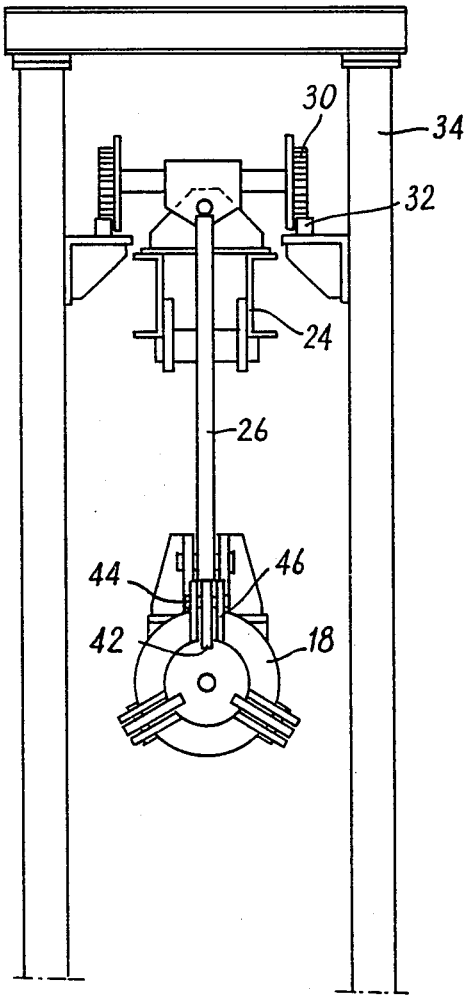

With reference to the drawings, one sees that the device according to this invention includes a set of slanting rollers of which only one 10 is visible in FIG. 1) supporting the tube while it moves forward so that it can rotate freely about its axis and be delivered to an outer quenching system 12 of standard type comprising feeding ducts 14 for the quenching liquid, opening into a plurality of injection nozzles 16 distributed longitudinally on the path of travel of tube T and placed crownwise about said tube.

At the outlet of the outer quenching system 12 is provided a retractable carrier 18 on which is mounted the lance 20 for the injection of a quenching liquid inside tube T, said lance being fed via duct 22. Carrier 18 is hung onto a frame 24 via oscillating arms 26 driven by cylinders such as 28, and it can be moved longitudinally in the advancement direction of tube T by pinions 30 meshing with racks 32 mounted on a gantry support 34 supporting the whole carrier.

Lance 20 is provided with an end-piece 36 which can rotate freely about its axis due to a rotating joint 40, and which is formed with a frustoconical bearing surface 38 onto which the end of tube T comes to bear and is locked, as will be described hereafter. On said end-piece 36 are mounted tilting clamping pliers 42. As can be seen in FIG. 1, said pliers 42 are mounted on a stirrup 46 so as to be able to tilt about axis 44 and they are formed on their posterior portion with a slanting plane 48 coming to bear against a frustoconical surface 50 provided on a sleeve 52 mounted on the injection lance 20. Said sleeve 52 is biased against end-piece 36 by a cylinder 54 mounted on carrier 18 and acting on an articulated lever 56 the end of which carries a ring 58 positioned in an annular groove 60 so that the end-piece 36-sleeve 52 assmbly can rotate about its axis during the inner quenching of rotating tube T.

Finally, the apparatus includes a plurality of retractable rollers 62 for the discharge of the tube after quenching.

The operation of this apparatus is the following:

Tube T is fed while rotating about itself and being supported on slanting rollers such as 10, and it passes through the outer quenching system 12. At the outlet of said system 12, its anterior end comes in abutment against end-piece 36 and is locked by being centered in the frustoconical bearing surface 38 formed at the end of said end-piece. The clamping pliers 42 of the tube are actuated by cylinder 54 which, by displacing slightly sleeve 52 with respect to end-piece 36, causes the tilting of pliers 42 about their axis 44, due to the two slanting surfaces 48, 50 sliding against one another. The tube is thereby locked onto the end-piece, the quenching liquid is injected inside the tube by lance 20 while carrier 18 is returned on its rolling path by the pinion-rack system 32, allowing the whole system to accompany the end of the moving tube.

As the carrier moves backward and disengages the tube from the outer quenching system 12, the retractable rollers 62 come in position so as to support the moving tube. When the totality of the tube is outside quenching system 12, the opening of pliers 42 is controlled by cylinder 54 in order to disengage end-piece 36, adn cylinder 28 is actuated so as to retract carrier 18 and applying it against its frame 24 hung to gantry support 34, and to clear the roller path 62. After discharge of the quenched tube, the whole assembly is returned to its starting position in order to treat a new tube.

It is of course to be understood that this invention is not limited to the embodiment described and shown and that it encompasses all the variants thereof.

We claim:

1. An apparatus for outer quenching and inner quenching of tubular pieces comprising successively in an advancing direction of movement of the tubular pieces:

slanting rollers allowing tubular pieces delivered continuously to move forward successively by rotating about their axis;

an outer quenching system;

a clamping and locking system for the tubular pieces;

a retractable carrier supporting an injection lance for carrying out an inner quenching of the tubular pieces, said clamping and locking system for the tubular pieces being associated with the retractable carrier;

means for allowing said retractable carrier to move backward with said clamping and locking system in order to accompany movement of the tubular pieces while the outer quenching is carried out; and retractable rollers which come in position to support the tubular pieces as the carrier moves backward while disengaging the tubular pieces from the outer quenching system.

2. An apparatus according to claim 1, wherein said clamping and locking system is rigid with said carrier and includes a hollow end-piece inside which opens the injection lance, said hollow end-piece including a frustoconical bearing surface on its face which is opposite the outer quenching system in order to lock the front end of a tubular piece exiting from the outer quenching system and pliers tiltably mounted on said end-piece in order to clamp a tubular piece when the tubular piece comes in abutment against said end-piece.

3. An apparatus according to claim 2, wherein the clamping of said pliers is controlled by a cylinder mounted on the carrier, which moves in translation a sleeve mounted on the injection lance, said sleeve being formed with a frustoconical surface on which bears a corresponding surface of each plier so that relative displacement of said surfaces causes the tilting of the pliers and the clamping of the pliers.

4. an apparatus according to claim 2, wherein the carrier is mounted on a frame via arms which are driven by cylinders, said frame moving on a rolling path provided on a gantry support and supporting the carrier.

5. An apparatus for performing an outer and inner quenching of tubular pieces comprising successively in an advancing direction of movement of the tubular pieces;

(a) means for supporting and delivering tubular pieces, said means for supporting and delivering tubular pieces being adapted to permit a tubular piece being supported and delivered to freely rotate about its axis;

(b) an outer quenching system adapted to perform an outer quenching of the tubular pieces;

(c) a retractable carrier supporting an injection lance for performing an inner quenching of the tubular pieces, and supporting a clamping and locking system for the tubular pieces;

(d) means for allowing the retractable carrier to move forward and backward to bring said tube clamping and locking system into contact with a front end of a tubular piece as the tubular piece emerges from said outer quenching system to permit inner quenching of the tubular piece while the outer quenching is being performed; and (e) retractable means for supporting the tubular pieces, said retractable means for supporting the tubular pieces being adapted to come into position to support the tubular pieces as the retractable carrier moves backward and the tubular pieces become disengaged from the outer quenching system.

6. The apparatus according to claim 5, wherein said clamping and locking system is rigidly mounted on said retractable carrier.

7. The apparatus according to claim 6, wherein said clamping and locking system includes a hollow end-piece inside which opens the injection lance.

8. The apparatus according to claim 7, wherein said hollow end-piece includes a frustoconical bearing surface on its face, opposite the outer quenching system, adapted to lock the front end of a tubular piece exiting from the outer quenching system, and pliers being tiltably mounted on said hollow end-piece to clamp a tubular piece when the tubular piece comes in abutment against said frustoconical bearing surface.

9. The apparatus according to claim 8, wherein tilting of said pliers to clamp a tubular piece is controlled by a cylinder adapted to move a sleeve mounted on the injection lance; said sleeve being formed with a frustoconical surface on which bears a corresponding surface of each plier so that relative displacement of said surfaces causes tilting and clamping of the pliers on a tubular piece.

10. The apparatus according to claim 5, wherein said means for allowing the retractable carrier to move forward and backward comprise a frame on which said retractable carrier is mounted via arms which are driven by cylinders; and said frame being longitudinally movable in the advancing direction of movement on means forming a rolling path mounted on a gantry support.

11. The apparatus according to claim 8, wherein said means for allowing the retractable carrier to move forward and backward comprise a frame on which said retractable carrier is mounted via arms which are driven by cylinders; and said frame being longitudinally movable in the advancing direction of movement on means forming a rolling path mounted on a gantry support.

12. The apparatus according to claim 9, wherein said means for allowing the retractable carrier to move forward and backward comprise a frame on which said retractable carrier is mounted via arms which are driven by cylinders; and said frame being longitudinally movable in the advancing direction of movement on means forming a rolling path mounted on a gantry support.

13. The apparatus according to claim 10, wherein said means forming a rolling path comprise a rack and pinion system.

14. The apparatus according to claim 11, wherein said means forming a rolling path comprise a rack and pinion system.

15. The apparatus according to claim 12, wherein said means forming a rolling path comprise a rack and pinion system.

16. The apparatus according to claim 5, wherein said means for supporting and delivering tubular pieces comprises slanting rollers.

17. The apparatus according to claim 5, wherein said retractable means for supporting the tubular pieces comprise retractable rollers.

18. The apparatus according to claim 2, wherein said hollow end-piece includes a rotating joint and is adapted to rotate about its axis.

19. The apparatus according to claim 7, wherein said hollow end-piece includes a rotating joint and is adapted to rotate about its axis.

20. The apparatus according to claim 8, wherein said hollow end-piece includes a rotating joint and is adapted to rotate about its axis.

* * * * *